United States Patent [19]

Ruppel et al.

[11] Patent Number: 4,488,605

[45] Date of Patent: Dec. 18, 1984

[54] EXTENDIBLE SHANK AUGER

[76] Inventors: Richard W. Ruppel, R.R. 4; Mark G. Ruppel, R.R. 1, both of Cumberland, Wis. 54829

[21] Appl. No.: 372,963

[22] Filed: Apr. 29, 1982

[51] Int. Cl.[3] ..... E21B 17/07; F25C 5/04

[52] U.S. Cl. ..... 175/18; 175/321; 175/394; 145/64; 403/107

[58] Field of Search ..... 175/18, 321, 322, 394; 145/64, 116 R; 403/107, 108, 348, 349; 464/162, 163; 408/226, 238, 239 R

[56] References Cited

U.S. PATENT DOCUMENTS

| | | | |
|---|---|---|---|
| 468,595 | 2/1892 | Bunch | 145/64 |
| 933,878 | 9/1909 | Borsch | 145/64 |
| 1,284,351 | 11/1918 | Jagielo | 403/107 |
| 2,694,552 | 11/1954 | Vadnais | 175/18 |
| 2,695,504 | 11/1954 | Magee | 464/162 |
| 2,865,608 | 12/1958 | McKenna | 175/394 |
| 2,955,805 | 1/1959 | Jones et al. | 255/69 |
| 3,080,006 | 10/1960 | Brolin | 175/18 |
| 3,430,456 | 7/1967 | Stricker | 64/1 |
| 3,929,196 | 12/1975 | Rantanen | 175/18 |

FOREIGN PATENT DOCUMENTS

| | | | |
|---|---|---|---|
| 35746 | 3/1966 | Finland | 175/18 |

*Primary Examiner*—James A. Leppink
*Assistant Examiner*—Hoang C. Dang
*Attorney, Agent, or Firm*—Burd, Bartz & Gutenkauf

[57] ABSTRACT

A drill assembly or auger for forming a hole in a surface such as ice and having a readily extendible and retractable shank assembly. The shank assembly has first and second longitudinal shank members. One shank member is telescopically engagable in the other shank member and moveable between a first relatively retracted configuration of the shank assembly and a second relatively extended configuration of the shank assembly.

First and second coupling members are located at longitudinally spaced intervals on said shank assembly for coupling the shank member having cutting means to the shank member with operating structure upon operation of the operating structure to rotate the shank assembly in a direction to form a hole selectively in the first and second positions respectively.

The coupling members are releasable for telescopic movement of the shank members between positions by rotation of the shank member having the operating structure in a direction opposite that necessary to form a hole.

10 Claims, 13 Drawing Figures

EXTENDIBLE SHANK AUGER

BACKGROUND OF THE INVENTION

The invention relates to a drill or auger such as an auger of the type for boring a hole in ice covering a lake for fishing, and having a readily extendible shank for penetration of relatively thick ice.

In the wintertime in northern climates, ice fishing is popular as a sport as well as a means of obtaining food. Prepatory to ice fishing, the ice fisherman must make a hole in the ice to gain access to the underlying water. The fisherman typically uses an ice auger or drill to accomplish this task. The auger can be manually operated or motor driven.

In forming a hole in the ice, as the working tip of the auger penetrates the ice, the entire auger advances downwardly. When depths of two or three feet or more are required, the operating end of the tool advances downwardly to a point where the operator assumes an uncomfortable bent over position in which work is strenuous and fatiguing.

The present invention contemplates an ice or earth drilling auger having a readily extendible shank assembly movable between a retracted foreshortened configuration and an extended elongate configuration. The shank assembly has first and second telescoping members. A drill bit or other cutting element is located at the distal end of one of the members, and an operating means such as a handle assembly is fastened on the distal end of the other member. One of the shank members is tubular and telescopically receives the proximal end of the other member. Means are provided on the first and second members in at least two telescopically spaced apart positions for interlocking the two members upon rotation of the operating means in direction to form a hole. Unlocking of the two members is accomplished by reverse rotation so that the relative telescopic positioning of the two members is readily altered.

IN THE DRAWINGS

DESCRIPTION OF PREFERRED EMBODIMENTS

Figure 1:
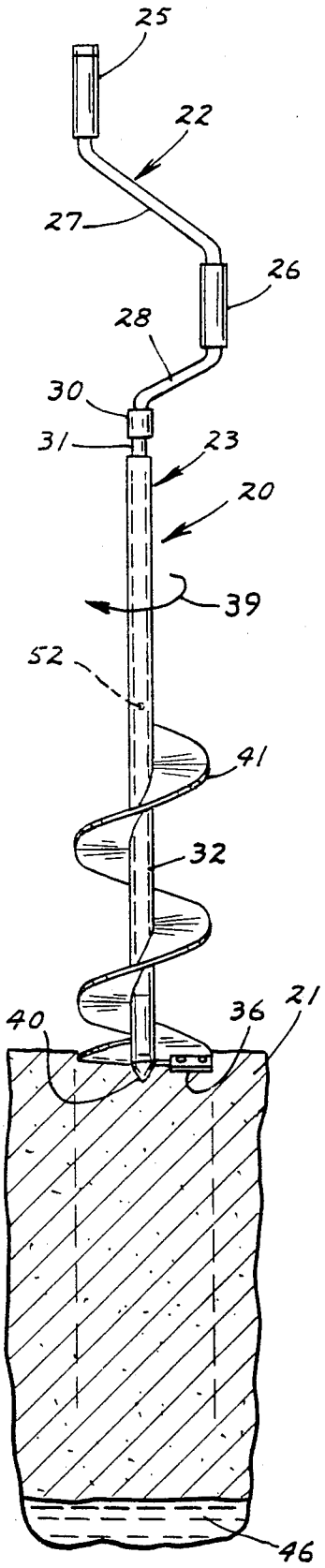
FIG. 1 is a side elevational view of a first form of the auger of the invention with the shank assembly in a relatively retractd configuration prepatory to forming a hole in a body of ice.

Referring to the drawings, there is shown in FIGS. 1 through 7 an auger 20 according to a first form of the invention adapted to form a hole in a body of ice 21. Auger 20 includes operating means shown to include a manually operable handle assembly 22 connected to a shank assembly 23. Handle assembly 22 includes offset handle portions 25, 26 having freely rotatable grip portions and connected by a crank arm 27. A second crank arm 28 extends from the lower handle portion 26 to a threaded coupling 30.

Drive shaft or shank assembly 23 includes a first or upper shank member 31 and a second or lower shank member 32. Lower shank member 32 is tubular and telescopically houses the proximal end of the upper shank member 31. Upper shank member 31 is telescopically movable in the lower shank member 32 so as to be movable between positions shown in FIG. 1 in a relatively retracted configuration to a position as shown in FIG. 2 in a relatively elongated configuration. The upper end of first shank member 31 is reduced and threaded as shown at 34 in FIG. 4 for engagement with threaded coupling 30.

Figure 2:
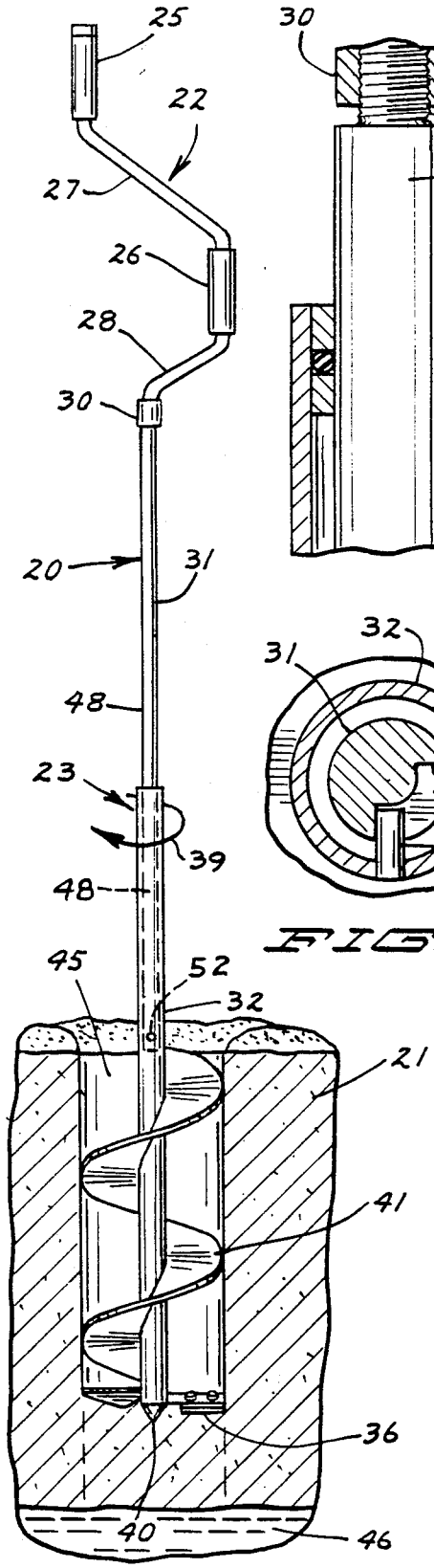
FIG. 2 is a side elevational view of the auger of FIG. 1 with the shank assembly in a relatively extended configuration having begun formation of a hole in a body of ice.
Figure 3:
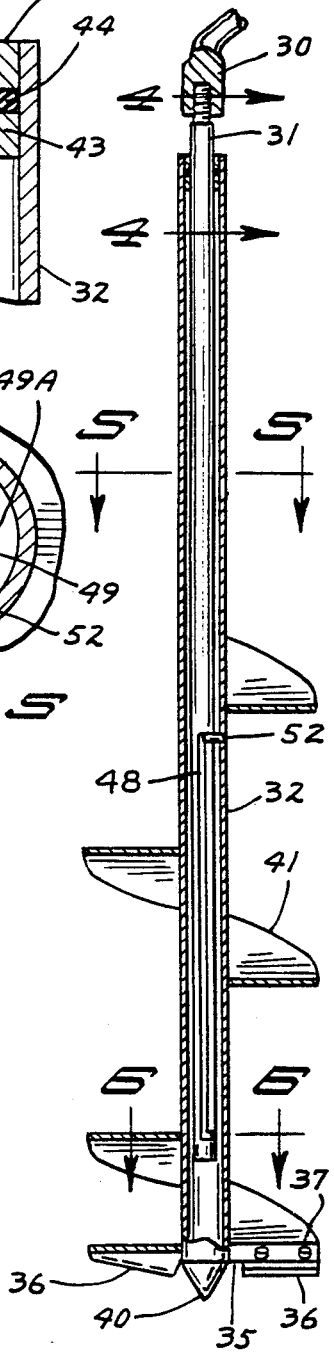
FIG. 3 is an enlarged sectional view of the lower portion of the auger of FIG. 1.

Cutting means on lower shank member 32 for boring into the ice 21 include a pair of blade mounting plates 35 (only one of which is shown in FIG. 3) secured to the end of lower shank member 32 as by a weld. Plates 35 extend in opposite directions generally perpendictular to the axis of lower shank member 32. A removable cutting blade 36 is removably secured to each of the mounting plates 35 as by bolts 37. The cutting edges of blades 36 are orientated slightly downward so as to be in cutting relationship to the surface upon advanced rotation of the lower shank member 32. Upon advanced rotation of the lower shank member 32 in a direction indicated by the arrow 39 in FIG. 2, cutting blades 36 are effective to cut or bore a hole in the ice 21. A centering point 40 is secured to the lower end of lower shank member 32 and is downwardly directed therefrom in order to center the shank member at the desired location. Other suitable and appropriate cutting or drilling means can be used according to the discretion of the user and the type of surface in which a hole is to be formed. A helical auger flight 41 is secured to the lower shank member 32 by appropriate means such as welding. Auger flight 41 extends over a portion of the length of lower shank member 32, terminating approximate the blade mounting plates 35. Auger flight 41 assists in removal of cut material from the hole being formed.

Figure 4:
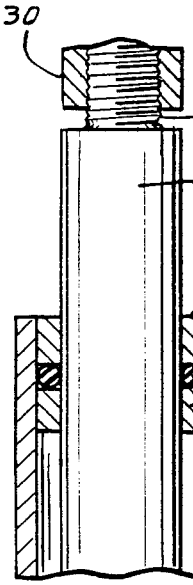
FIG. 4 is an enlarged sectional view of a portion of the auger shown in FIG. 3 taken along the line 4—4 thereof.

As shown in FIG. 4, the upper end of lower shank member 32 is interiorly fitted with a pair of spaced apart circular bushings 43. An O-ring 44 is located in the space between the bushings 43 and in contact with adjacent portions of the upper shank member 31 to effect a seal between the inner and outer portions of the lower shank member 32.

In use, auger 20 is initially used in a first configuration as shown in FIG. 1 with the shank assembly 23 in a relatively retracted position. Upon advanced rotation in a direction indicated by the arrow 39, a hole 45 is formed in the ice. Upon the forming of the hole 45, the tip 40 advances downwardly as does the handle assembly 22, eventually becoming uncomfortable for the operator who must assume a bent-over position. Upon reaching this point, the operator extends the shank assembly 23 to the second position shown in FIG. 2. The operator is then able to stand in a more upright position and continue boring the hole 45 until the underlying water 46 is reached.

Means are provided to lock the first and second shank members together for rotation in the direction in the arrow 39 in the first and second configurations in FIGS. 1 and 2 such that rotation of the handle assembly 22 and accordingly the upper shank member 31 results in corresponding rotation of the lower shank member 32 to accomplish formation of the hole 45.

Auger 20 is equipped with a drive coupling between upper and lower shank members whereby the upper shank member is operable to drive the lower shank member in the direction of rotation to form a hole in the ice. The coupling is engageable in two longitudinally spaced apart positions of the shank members, a first retracted position as shown in FIG. 1 and a second extended position as shown in FIG. 2. Upon rotation in a direction opposite to that for forming a hole, the coupling is released and telescopic movement of the upper and lower shank members between position can be accomplished.

Drive structure on first shank member 31 is engageable with bearing structure on second shank member 32 to bear against it on rotation of the first shank member 31 and cause rotation of second shank member 32 in the direction to form a hole. An elongate longitudinal groove 48 is formed in upper shank member 31 extending approximately midway thereof to the location proximate the lower end thereof. A first circumferencial slot 49 extends from the upper end of groove 48 in a circumferencial direction opposite that of the direction of rotation necessary to form a hole. A second slot 50 extends from the lower end of groove 48 in the same direction. A bearing member or pin 52 is fastened to the inner wall of lower shank member 32 and extends radially inward a sufficient distance to have an inner end located in groove 48. The lower end of upper shank member 31 is telescopically slidable in lower shank member 32 within limits determined by the upper and lower ends of groove 48. When the pin 52 is located at an end of groove 48, the upper shank member 31 is rotatable a slight distance to seat the pin 52 in either the upper slot 49 or the lower slot 50 to couple the upper and lower shank members for rotation in a direction to form a hole. When pin 52 engages lower slot 50, upper slot 49 is located beneath O-ring 44 to maintain a seal.

In use of auger 20, the operator grasps the handle portions 25, 26 of auger 20 with centering point 40 poised over the intended location of the hole. The auger is in the retracted configuration of FIG. 1 with pin 52 seated in upper slot 49 so that shoulder 49A at the end of slot 49 bears against pin 52 upon rotation of handle 22 in the direction to form a hole, thus to rotate the lower shank member 32. Upon rotation of the handle 22, the hole 45 is formed. When the lower end of lower shank 32 is advanced into the ice to a point where the operator wishes to extend the shank assembly, the operator simply rotates the handle 22 in the direction opposite that of rotation to form a hole. The pin 52 is unseated from the slot 49 and moves to a position shown in FIG. 5. The operator simply then pulls the upper shank 31 in an upward direction whereby the pin 52 rides in groove 48 as the groove moves upwardly. Pin 52 eventually reaches the bottom of groove 48. The operator then simply resumes rotation of the handle 22 in the direction to form a hole. Pin 52 moves into and seats in lower slot 50. The operator then continues rotation of the handle 22 until the proper hole 45 is formed through the ice. The extension of shank assembly 23 is accomplished quickly and easily by the operator without the necessity of removing his hands from the handle bar grip portions 25, 26.

Figure 5:
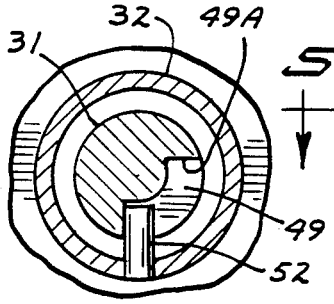
FIG. 5 is an enlarged sectional view of a portion of the auger of FIG. 3 taken along the line 5—5 thereof.
Figure 8:
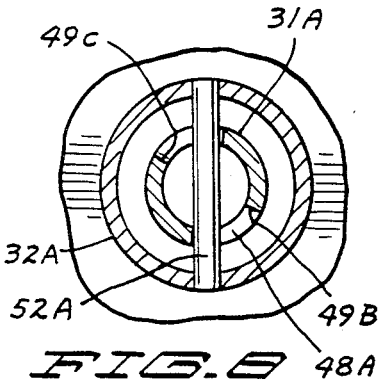
FIG. 8 is a transverse sectional view like that of FIG. 5 showing a modification of the shank assembly of the auger of FIG. 3.

A second form of the invention or modification of the auger 20 is shown in FIG. 8 which is a sectional view corresponding to that of FIG. 5. The end of the upper shank member 31A is telescopically engaged in the lower shank member 32A. The upper shank member 31A is tubular. A pin 52A extends diametrically across the interior of the lower shank member 32A. The groove 48A extends diametrically through and is located on either side of upper shank member 31A. Upper slots 49B and 49C are located on opposite sides of the tubular upper shank member 31A and extend from the top portions of the slot 48A. Lower slots are similarly disposed (not shown) extending from the lower end of the slot 48A. Upon rotation of the auger handle, pin 52A accordingly bares against diametrically opposed shoulders of the slots 49B, C.

A third form of the invention is shown in FIGS. 9 through 13. An auger 54, partially shown in FIG. 9 in a retracted configuration, has an extendible shank assembly 55. A first or upper shank member 56 is telescopically received in a second or lower shank member 57. Upper shank member 56 has an upper reduced, threaded portion 58 for attachment to operating means (not shown) such as a handle assembly or motor. The lower end of lower shank member 57 is equipped with cutting means (not shown) adapted to penetrate a surface when rotation is effected in the direction of the arrow 60.

Upper shank member 56 carries drive means for interaction with bearing elements of lower shank member 57 to rotate it in proper direction to form a hole, the drive means including first and second longitudinally spaced apart drive pins 61, 62 extended diametrically from upper shank member 56 proximate the lower end thereof. Drive pins 61, 62 extend outwardly a short distance from the surface of lower shank member 56.

Figure 10:
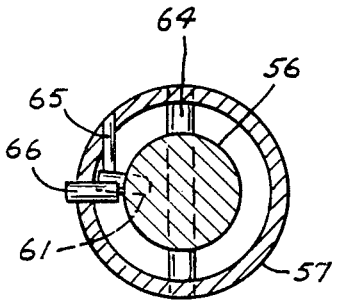
FIG. 10 is an enlarged sectional view of a portion of the auger of FIG. 9 taken along the line 10—10 thereof.
Figure 9:
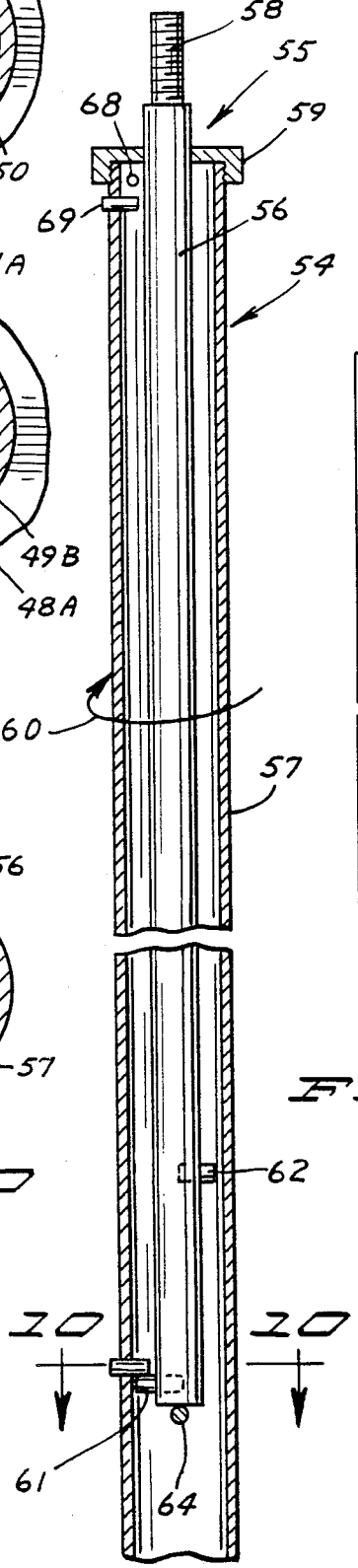
FIG. 9 is a longitudinal sectional view of a portion of an auger according to a third form of the invention in a relatively retracted configuration.

In the retracted configuration of FIG. 9, the lower end of upper shank member 56 is supported on a transverse support pin 64 extended diametrically through lower shank member 57. In this position, first drive pin 61 is in coplanar alignment with a first bearing pin 65 secured to the inner wall of lower shank member 57 and extending inwardly thereof. As shown in FIG. 10, rotation of the upper shank member 56 in proper direction to bore a hole brings the first drive pin 61 into contact with the first bearing pin 65 and further rotation results in rotation of the lower shank member 57 along with the upper shank member 56 in the direction of the arrow 60 to form a hole. A first retaining pin 66 is secured to the wall of the lower shank member 57 and extends inwardly thereof. First retaining pin 66 is positioned just above the bearing end of the first bearing pin 65 to inhibit upward movement of the first drive pin 61 and thus upper shank member 56 when the drive pin is in bearing relationship to the first bearing pin 65. It can be seen from FIG. 10 that rotation on the upper shank member 56 in a direction opposite that required for forming a hole moves the first drive pin 61 out of engagement with the first bearing pin 65 and in clearing relationship to the first retaining pin 66. In this position, the upper shank member 56 can be lifted with respect to the lower shank member 57 to be moved to the extended position shown in FIG. 11.

Figure 11:
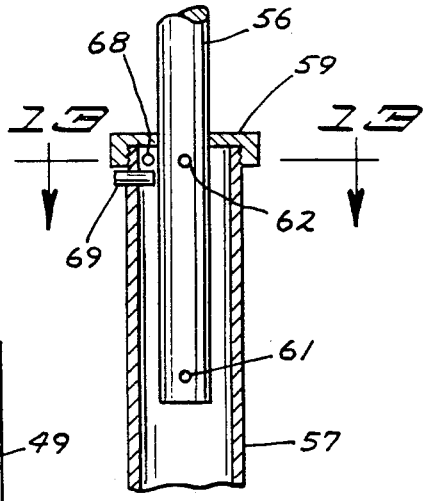
FIG. 11 is a longitudinal sectional view of a portion of the auger of FIG. 9 moved to the relatively extended position.
Figure 13:
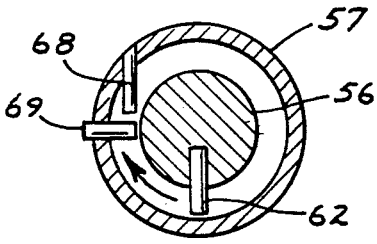
FIG. 13 is an enlarged sectional view of a portion of the auger shown in FIG. 11 taken along the line 13—13 thereof.

As shown in FIG. 11, upward movement of the upper shank member 56 is stopped by second drive pin 62 being intercepted by end cap 59. At this position, second drive pin 62 is in coplanar alignment with a second bearing pin 68. As shown in FIG. 13, rotation of the upper shank member 56 in the proper direction for boring a hole brings the second drive pin 62 into bearing relationship with the second bearing pin 68 whereupon further rotation results in rotation of both the upper shank member 56 and lower shank member 57. A second retaining pin 69 is fastened to the lower shank member 57 and extends inwardly therefrom to a position just beneath the point of contact of the second drive pin 62 and the second bearing pin 68. The second retaining pin 69 prevents downward movement of the second drive pin 62 and thus the upper shank member 56 when in bearing relationship to the second bearing pin 68. Reverse rotation of the upper shank member 56 results in release of the coupling between the second drive pin 62 and the second bearing pin 68, to a point of clearing relationship with the second retaining pin 69 whereby telescopic movement between the upper and lower shank members can be accomplished.

The use of the auger 54 is as previously described with respect to the auger 20. In the retracted position of FIG. 9, boring of a hole is commenced. When the shank assembly has advanced somewhat into the ice such that the operator has assumed a bent-over position, the upper shank member 56 is rotated slightly in the reverse direction to free the first drive pin 61 and permit upward extension of the upper shank member 56 to a point where the second drive pin 62 is in position for engagement of the second bearing pin 68 as shown in FIG. 13. Extension and retraction of the shank assembly 55 is quickly and easily accomplished.

While there have been shown and described certain preferred embodiments of the invention, it will be apparent that other embodiments can be derived without departing from the scope and spirit of the appended claims. For example, the shank assembly could be motor driven rather than rotated manually.

The embodiments of the invention in which an exclusive property or privilege is claimed are defined as follows:

1. A drill assembly for forming a hole, comprising:

a shank assembly having an upper longitudinal shank member and a lower longitudinal shank member, said lower shank member being tubular and said upper shank member having a portion telescopically engaged and axially rotatable in the lower shank member and telescopically movable therein between a first relatively retracted position with a substantial length of the upper shank member retracted into the lower shank member and a second relatively extended position of the shank assembly with a substantial length of the upper shank member outwardly extended from the lower shank member, said telescopic movement between the first and second positions being in excess of twenty-five percent of the length of one of the shank members;

cutting means located on the lower end of the lower shank member adapted to form a hole in a surface upon rotation in a first axial direction of rotation of the shank assembly;

operating means disposed at the upper end of the upper shank member for axial rotation of the shank assembly in said first direction;

releasable coupling means to couple the upper and lower shank members selectively in the first and second positions whereby rotation of the upper shank member in the first direction results in rotation of the lower shank member to form a hole, said coupling including an elongate longitudinal groove formed in the upper shank member having parallel uninterrupted side walls extending approximately midway on the upper shank member to a location proximate one end thereof, a first circumferential slot on the upper shank member extending from the upper end of the groove in perpendicular relationship to the groove in direction opposite to the first direction of rotation, a second circumferential slot on the upper shank member extending from the lower end of the groove in parallel relationship to the first slot, and a bearing pin fixed to the lower shank member and having an inwardly extended end locatable in said groove for relative telescopic movement between the upper and lower shank members, each slot having uninterrupted parallel side walls whereby the bearing pin is seated and unseated with respect to a slot by axial rotation of the upper shank member with respect to the lower shank member, said bearing pin being locatable in the first slot for coupling the upper and lower shank members in the first position, and locatable in the second slot for coupling the upper and lower shank members in the second position by axially rotating the upper shank member in a direction opposite the first direction of rotation to unseat the bearing pin from the first slot and permit the lower shank member to move to the second position whereby the bearing pin is seated in the second slot upon further rotation of the upper shank member in the first direction of rotation.

2. The drill assembly of claim 1 wherein: said groove and said first and second slots extends diametrically through the upper shank member, said bearing pin extending diametrically through the lower shank member and passing through said groove.

3. The drill assembly of claim 1 wherein: said cutting means includes a cutting blade assembly fixed to the outer end of the lower shank member, and a helical auger extended longitudinally along the lower shank member from said cutting means.

4. The drill assembly of claim 3 wherein: said operating means comprises a handle bar assembly.

5. The drill assembly of claim 1 including: an O-ring assembly assembled interiorly at the end of the lower shank member in telescopic receipt of the end of the upper shank member to seal the interior of the lower shank member.

6. A drill assembly for forming a hole comprising:

a shank assembly having a first longitudinal shank member and a second longitudinal shank member, said second shank member being tubular and said first shank member having a portion telescopically engaged in the second shank member and telescopically moveable therein between a first relatively retracted position and a second relatively extended position of the shank assembly;

cutting means located on an outer end of the second shank member adapted to form a hole in a surface upon rotation in a first axial direction of rotation of the shank assembly;

operating means disposed at the outer end of the first shank member for axial rotation of the shank assembly in said first direction;

releasable coupling means to couple the first and second shank members selectively in the first and second positions whereby rotation of the shank member having operating means in the first axial direction results in rotation of the shank member having cutting means to form a hole, said coupling means comprised as first pin means and second pin means, first pin means being drive pin means and the second pin means being bearing pin means, said first pin means comprised as pin members fixed to the first shank member and outwardly extended therefrom and second pin means comprised as pin members fixed to the tubular member and inwardly extended therefrom, said first pin means including a first drive pin member and a second drive pin member spaced from the first drive pin member, said first drive pin member positioned to be engagable with a pin member of the second pin means when the first and second shank members are in the first position and the first shank member is rotated in said first axial direction, said second drive pin member positioned to be engagable with a pin member of the second pin means when the first and second shank members are in the second position and the first shank is rotated in said first axial direction to rotate the second shank member in the first axial direction, and said drive pins being disengagable with the second pin means upon rotation of the shank member in a direction opposite the first axial direction.

7. The drill assembly of claim 6 wherein: the second pin means includes a first bearing pin member and a second bearing pin member, said first drive pin member engagable with the first bearing pin member when the first and second shank members are in the first position, said second drive pin member being engagable with the second bearing pin member when the first and second shank members are in the second position.

8. The drill assembly of claim 7 including: a first retaining pin secured to the second shank member and positioned to maintain the first drive pin member in engagement with the first bearing pin member when the first and second shank members are in the first position and the first shank member is rotated in the first axial direction, and a second retaining pin secured to the second shank member and positioned to maintain the second drive pin member in engagement with the second bearing pin member when the first and second shank members are in the second position and the first shank member is rotated in the first axial direction.

9. The drill assembly of claim 8 wherein: said operating means comprises a handle bar assembly.

10. The drill assembly of claim 6 wherein: said second pin means including a first bearing pin member and a second bearing pin member, said bearing pin members extending inwardly from the second shank member, said first bearing pin member positioned to be engagable by a pin member of the first pin means when the first and second shank members are in the first position and the first shank member is rotated in the first axial direction, said second bearing pin member positioned to be engagable by a pin member of the first pin means when the first and second shank members are in the second position and the first shank member is rotated in the first axial direction.

* * * * *

UNITED STATES PATENT AND TRADEMARK OFFICE

CERTIFICATE OF CORRECTION

PATENT NO. : 4,488,605

DATED : December 18, 1984

INVENTOR(S) : Richard W. Ruppel et al.

It is certified that error appears in the above-identified patent and that said Letters Patent is hereby corrected as shown below:

Insert columns 1 and 2 as shown on the attached sheet.

(IN THE GRANT ONLY)

Signed and Sealed this

*Tenth* Day of *December 1985*

[SEAL]

*Attest:*

*Attesting Officer*

DONALD J. QUIGG

*Commissioner of Patents and Trademarks*

EXTENDIBLE SHANK AUGER

BACKGROUND OF THE INVENTION

The invention relates to a drill or auger such as an auger of the type for boring a hole in ice covering a lake for fishing, and having a readily extendible shank for penetration of relatively thick ice.

In the wintertime in northern climates, ice fishing is popular as a sport as well as a means of obtaining food. Prepatory to ice fishing, the ice fisherman must make a hole in the ice to gain access to the underlying water. The fisherman typically uses an ice auger or drill to accomplish this task. The auger can be manually operated or motor driven.

In forming a hole in the ice, as the working tip of the auger penetrates the ice, the entire auger advances downwardly. When depths of two or three feet or more are required, the operating end of the tool advances downwardly to a point where the operator assumes an uncomfortable bent over position in which work is strenuous and fatiguing.

The present invention contemplates an ice or earth drilling auger having a readily extendible shank assembly movable between a retracted foreshortened configuration and an extended elongate configuration. The shank assembly has first and second telescoping members. A drill bit or other cutting element is located at the distal end of one of the members, and an operating means such as a handle assembly is fastened on the distal end of the other member. One of the shank members is tubular and telescopically receives the proximal end of the other member. Means are provided on the first and second members in at least two telescopically spaced apart positions for interlocking the two members upon rotation of the operating means in direction to form a hole. Unlocking of the two members is accomplished by reverse rotation so that the relative telescopic positioning of the two members is readily altered.

IN THE DRAWINGS

Figure 6:
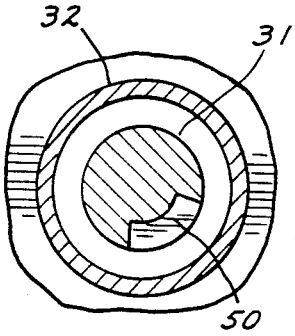
FIG. 6 is an enlarged sectional view of the portion of the auger of FIG. 3 taken along the line 6—6 thereof.
Figure 7:
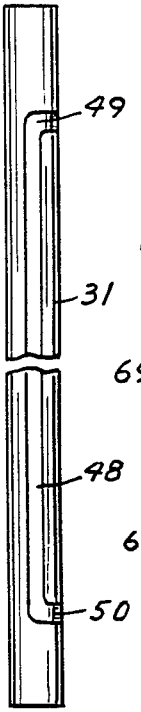
FIG. 7 is an enlarged fragmentary view of a portion of the ice auger shank of FIG. 3.
Figure 12:
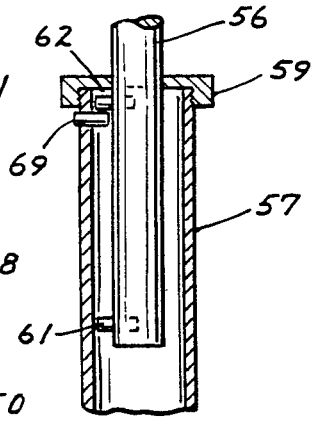
FIG. 12 is a longitudinal sectional view of the portion of the auger shown in FIG. 11 with one member of the shank assembly rotated to a position to initiate rotation of the other member.

FIG. 1 is a side elevational view of a first form of the auger of the invention with the shank assembly in a relatively retractd configuration prepatory to forming a hole in a body of ice;

FIG. 2 is a side elevational view of the auger of FIG. 1 with the shank assembly in a relatively extended configuration having begun formation of a hole in a body of ice;

FIG. 3 is an enlarged sectional view of the lower portion of the auger of FIG. 1;

FIG. 4 is an enlarged sectional view of a portion of the auger shown in FIG. 3 taken along the line 4—4 thereof;

FIG. 5 is an enlarged sectional view of a portion of the auger of FIG. 3 taken along the line 5—5 thereof;

FIG. 6 is an enlarged sectional view of the portion of the auger of FIG. 3 taken along the line 6—6 thereof;

FIG. 7 is an enlarged fragmentary view of a portion of the ice auger shank of FIG. 3;

FIG. 8 is a transverse sectional view like that of FIG. 5 showing a modification of the shank assembly of the auger of FIG. 3;

FIG. 9 is a longitudinal sectional view of a portion of an auger according to a third form of the invention in a relatively retracted configuration;

FIG. 10 is an enlarged sectional view of a portion of the auger of FIG. 9 taken along the line 10—10 thereof;

FIG. 11 is a longitudinal sectional view of a portion of the auger of FIG. 9 moved to the relatively extended position;

FIG. 12 is a longitudinal sectional view of the portion of the auger shown in FIG. 11 with one member of the shank assembly rotated to a position to initiate rotation of the other member;

FIG. 13 is an enlarged sectional view of a portion of the auger shown in FIG. 11 taken along the line 13—13 thereof;

DESCRIPTION OF PREFERRED EMBODIMENTS

Referring to the drawings, there is shown in FIGS. 1 through 7 an auger 20 according to a first form of the invention adapted to form a hole in a body of ice 21. Auger 20 includes operating means shown to include a manually operable handle assembly 22 connected to a shank assembly 23. Handle assembly 22 includes offset handle portions 25, 26 having freely rotatable grip portions and connected by a crank arm 27. A second crank arm 28 extends from the lower handle portion 26 to a threaded coupling 30.

Drive shaft or shank assembly 23 includes a first or upper shank member 31 and a second or lower shank member 32. Lower shank member 32 is tubular and telescopically houses the proximal end of the upper shank member 31. Upper shank member 31 is telescopically movable in the lower shank member 32 so as to be movable between positions shown in FIG. 1 in a relatively retracted configuration to a position as shown in FIG. 2 in a relatively elongated configuration. The upper end of first shank member 31 is reduced and threaded as shown at 34 in FIG. 4 for engagement with threaded coupling 30.

Cutting means on lower shank member 32 for boring into the ice 21 include a pair of blade mounting plates 35 (only one of which is shown in FIG. 3) secured to the end of lower shank member 32 as by a weld. Plates 35 extend in opposite directions generally perpendictular to the axis of lower shank member 32. A removable cutting blade 36 is removably secured to each of the mounting plates 35 as by bolts 37. The cutting edges of blades 36 are orientated slightly downward so as to be in cutting relationship to the surface upon advanced rotation of the lower shank member 32. Upon advanced rotation of the lower shank member 32 in a direction indicated by the arrow 39 in FIG. 2, cutting blades 36 are effective to cut or bore a hole in the ice 21. A centering point 40 is secured to the lower end of lower shank member 32 and is downwardly directed therefrom in order to center the shank member at the desired location. Other suitable and appropriate cutting or drilling means can be used according to the discretion of the user and the type of surface in which a hole is to be formed. A helical auger flight 41 is secured to the lower shank member 32 by appropriate means such as welding. Auger flight 41 extends over a portion of the length of lower shank member 32, terminating approximate the blade mounting plates 35. Auger flight 41 assists in removal of cut material from the hole being formed.

As shown in FIG. 4, the upper end of lower shank member 32 is interiorly fitted with a pair of spaced apart circular bushings 43. An O-ring 44 is located in the space between the bushings 43 and in contact with adjacent portions of the upper shank member 31 to effect a